US009453617B2

(12) United States Patent
Loh

(10) Patent No.: US 9,453,617 B2
(45) Date of Patent: Sep. 27, 2016

(54) LED LIGHT DEVICE WITH IMPROVED THERMAL AND OPTICAL CHARACTERISTICS

(76) Inventor: Ban P. Loh, San Jose, CA (US)

( * ) Notice: Subject to any disclaimer, the term of this patent is extended or adjusted under 35 U.S.C. 154(b) by 595 days.

(21) Appl. No.: 13/163,437

(22) Filed: Jun. 17, 2011

(65) Prior Publication Data

US 2011/0248619 A1 Oct. 13, 2011

Related U.S. Application Data

(63) Continuation-in-part of application No. 13/019,900, filed on Feb. 2, 2011.

(60) Provisional application No. 61/364,567, filed on Jul. 15, 2010, provisional application No. 61/480,646, filed on Apr. 29, 2011, provisional application No. 61/302,474, filed on Feb. 8, 2010.

(51) Int. Cl.

| | |
|---|---|
| ***F21V 29/00*** | (2015.01) |
| ***F21K 99/00*** | (2016.01) |
| *F21V 3/00* | (2015.01) |
| *F21Y 101/02* | (2006.01) |

(52) U.S. Cl.

CPC ..... *F21K 9/135* (2013.01); *F21K 9/137* (2013.01); *F21V 29/00* (2013.01); *F21K 9/50* (2013.01); *F21V 3/00* (2013.01); *F21Y 2101/02* (2013.01)

(58) Field of Classification Search

CPC .. F21Y 2101/02; F21K 9/135; F21V 29/004; F21V 3/00

USPC ..... 362/294, 373, 249.02

See application file for complete search history.

(56) References Cited

U.S. PATENT DOCUMENTS

| | | | | |
|---|---|---|---|---|
| 7,677,767 | B2 * | 3/2010 | Chyn | 362/294 |
| 7,708,452 | B2 * | 5/2010 | Maxik et al. | 362/650 |
| 8,011,808 | B2 * | 9/2011 | Liu | 362/294 |
| 8,016,458 | B2 * | 9/2011 | Liu et al. | 362/294 |
| 8,231,250 | B2 * | 7/2012 | Bailey | 362/328 |
| 8,274,241 | B2 * | 9/2012 | Guest et al. | 315/294 |
| 8,362,677 | B1 * | 1/2013 | Morejon et al. | 313/46 |
| 8,449,137 | B2 * | 5/2013 | Dassanayake et al. | 362/217.06 |
| 2007/0063321 | A1 | 3/2007 | Han | |
| 2007/0200133 | A1 | 8/2007 | Hashimoto | |
| 2007/0243645 | A1 | 10/2007 | Lin | |
| 2009/0040766 | A1 | 2/2009 | Pabst | |
| 2009/0086492 | A1 | 4/2009 | Meyer | |
| 2009/0237932 | A1 * | 9/2009 | Lee | 362/249.02 |
| 2009/0284973 | A1 | 11/2009 | Liao | |
| 2009/0296387 | A1 * | 12/2009 | Reisenauer et al. | 362/235 |
| 2012/0320593 | A1 * | 12/2012 | Betsuda et al. | 362/249.02 |

FOREIGN PATENT DOCUMENTS

KR 1020090003378 A 1/2009

* cited by examiner

*Primary Examiner* — Peggy Neils

(57) ABSTRACT

A lighting device such as a light bulb is disclosed. The lighting device includes an optical sub-assembly adapted to generate light when electrically excited; a body sub-assembly thermally coupled to the optical sub-assembly to draw heat away from the optical sub-assembly and to dissipate it; an electrical sub-assembly electrically connecting the optical sub-assembly to the body sub-assembly; and a final assembly covering at least a portion of the optical sub-assembly.

20 Claims, 17 Drawing Sheets

LED LIGHT DEVICE WITH IMPROVED THERMAL AND OPTICAL CHARACTERISTICS

CROSS-REFERENCE TO RELATED APPLICATIONS

The present application claims the benefit of priority under 35 USC sections 119 and 120 of a provisional patent application filed Jul. 15, 2010 having Application Ser. No. 61/364,567. The entirety of the 61/364,567 application is incorporated herein by reference. The applicant claims benefit to Jul. 15, 2010 as the earliest priority date for the matter disclosed therein for the first time. The present application claims the benefit of priority under 35 USC sections 119 and 120 of a patent application filed Feb. 2, 2011 having application Ser. No. 13/019,900. The entirety of the Ser. No. 13/019,900 application is incorporated herein by reference. The present application claims the benefit of priority under 35 USC sections 119 and 120 of a provisional patent application filed Apr. 29, 2011 having Application Ser. No. 61/480,646. The entirety of the Ser. No. 61/480,646 application is incorporated herein by reference.

BACKGROUND

The present invention relates to light emitting devices. More particularly, the present invention relates to light emitting devices and lighting devices.

Some light emitting diode (LED) based lighting device manufacturers such as Osram®, LumiLeds®, and others sell high-power LED modules, each module including one or more LED packages mounted on PCB (Printed Circuit Board) or MCPCB (Metal Core Printed Circuit Board). For example, these include FR-4 and FR-5 boards. FR-4 and FR-5 are popular insulating boards upon which many printed circuit boards are produced. Typically, FR-4 and FR-5 boards include a thin layer of copper foil which is laminated to one, or both sides with glass epoxy panel. Other configurations are also used for FR-4 and FR-5 PCBs.

The existing LED modules typically include PCB or MCPCB in a mostly two dimensional structural design. Further, there are little or no structures for alignment of various portions of the LED modules to other portions or with external structures such as, for example, electrical cable or wires for connection to other circuits. In the existing technology, hot-bar soldering technique is used to solder cable and wires of the sample prior art LED module to PCB. Thus, the assembly process may lead to repeated heating cycles of soldering heat on the board that can damage the LED semiconductor itself or destroy the delicate balance and interaction of the various elements inside the LED module and LED package due to their differential physical and thermal properties.

Heat is one of the worst enemies of LED modules because, in part, heat can permanently damage and substantially degrade luminous output and long term lumen maintenance performance. Further, heat can even destroy the LED module entirely when it is heated over 200 degrees, Celsius, for a prolong period of time, for example, for more than a few minutes. Therefore, it is difficult to solder several loose wires on a MCPCB or PCB without adversely affecting the LED module.

Accordingly, there remains a need for an improved LED module that eliminates or alleviates these problems.

SUMMARY

The need is met by the present invention. In a first embodiment of the present invention, a light bulb includes an optical sub-assembly; a body sub-assembly; an electrical sub-assembly; and a final assembly. The optical sub-assembly is adapted to generate light when electrically excited. The body sub-assembly is thermally coupled to the optical sub-assembly. The electrical sub-assembly electrically connects the optical sub-assembly to the body sub-assembly. The final assembly covers at least a portion of the optical sub-assembly.

The optical sub-assembly includes a light emitting module thermally coupled to an intermediate heat sink. The body sub-assembly includes a body thermally coupled to the optical sub-assembly and a screw cap electrically coupled to the optical sub-assembly. The electrical sub-assembly includes a driver board electrically connected to the optical sub-assembly and wire electrically connecting the driver board with the body sub-assembly. The final assembly includes a reflector placed proximal to the optical sub-assembly and a lens covering at least a portion the optical sub-assembly.

In a second embodiment of the present invention, a lighting device includes a body, an intermediate heat sink, a light emitting module, and electrical connection from the light emitting modules to a screw cap. Heat from the light emitting modules is drawn to the intermediate heat sink, then to the body for dissipation. The intermediate heat sink has mounting slots and is thermally coupled to the body. The light emitting module is mounted on the intermediate heat sink and is thermally coupled to the intermediate heat sink. The electrical connection from the light emitting modules to a screw cap allows delivery of external electrical power to the light emitting modules. The body may include a plurality of heat sink fins.

The lighting device includes a reflector proximal to the light emitting modules and a lens covering the light emitting modules. In the lighting device, the light emitting modules are thermally coupled to the intermediate heat sink using solder or using thermal adhesive. In the lighting device, the intermediate heat sink include exposed external surface.

In a third embodiment of the present invention, a lighting device includes a body; an intermediate heat sink; a plurality of light emitting modules; and electrical connection from the light emitting modules extending beyond the body. Heat from the light emitting modules is drawn to the intermediate heat sink, then to the body for dissipation. The intermediate heat sink has a plurality of slots, the intermediate heat sink thermally coupled to the body. The light emitting modules are mounted on the intermediate heat sink, each light emitting module thermally coupled to the intermediate heat sink. The electrical connection allows for delivery of external electrical power to the light emitting modules. The intermediate heat sink includes exposed external surface. The body includes a plurality of heat sink fins. A reflector is placed proximal to the light emitting modules and a lens covers the light emitting modules. The light emitting modules are thermally coupled to the intermediate heat sink using solder or thermal adhesive.

DETAILED DESCRIPTION

The present invention will now be described with reference to the Figures which illustrate various aspects, embodiments, or implementations of the present invention. In the Figures, some sizes of structures, portions, or elements may be exaggerated relative to sizes of other structures, portions, or elements for illustrative purposes and, thus, are provided to aid in the illustration and the disclosure of the present invention.

This patent application claims the benefit of, and priority of, and incorporates by reference the entirety of U.S. Provisional Patent Application No. 61/364,567 filed Jul. 7, 2010. In addition, the present patent application claims the benefit of, priority of, and incorporates by reference the entirety of U.S. patent application Ser. No. 13/019,900 filed on Feb. 2, 2011, which, in turn, claims the benefit of, priority of, and incorporates by reference the entirety of U.S. Provisional Patent Application No. 61/302,474 filed Feb. 8, 2010.

Each of the incorporated documents (including provisional applications and non-provisional applications) includes drawings and specifications having figure designations, reference numbers, and their descriptions. To preserve consistency, some (but not all) figure designations, reference numbers, or both (of one or more of the incorporated documents) are used in the present document for portions or structures of various embodiments that corresponds to identical or similar portions or structures of embodiments disclosed by the incorporated documents. However, in general, to avoid confusion and to describe the inventions with even more clarity, in this document, figure designations, reference numbers, and their descriptions are independent from and of the incorporated documents. To avoid duplication and clutter, and to increase clarity, in the Figures, not every referenced portion is annotated with its reference number in every Figure.

The invention is disclosed in the following example embodiments: a globe lamp illustrated in FIGS. 1 through 5, and discussed below; Parabolic Aluminized Reflector (PAR) lamp illustrated in FIGS. 6 through 8 and 10, and discussed below; and Luminaire lamp illustrated in FIGS. 12 through 14 and discussed below. FIGS. 9 through 11D illustrate additional details of the light emitting module of the present invention which is a component of each of the embodiments disclosed herein.

Figure 1:
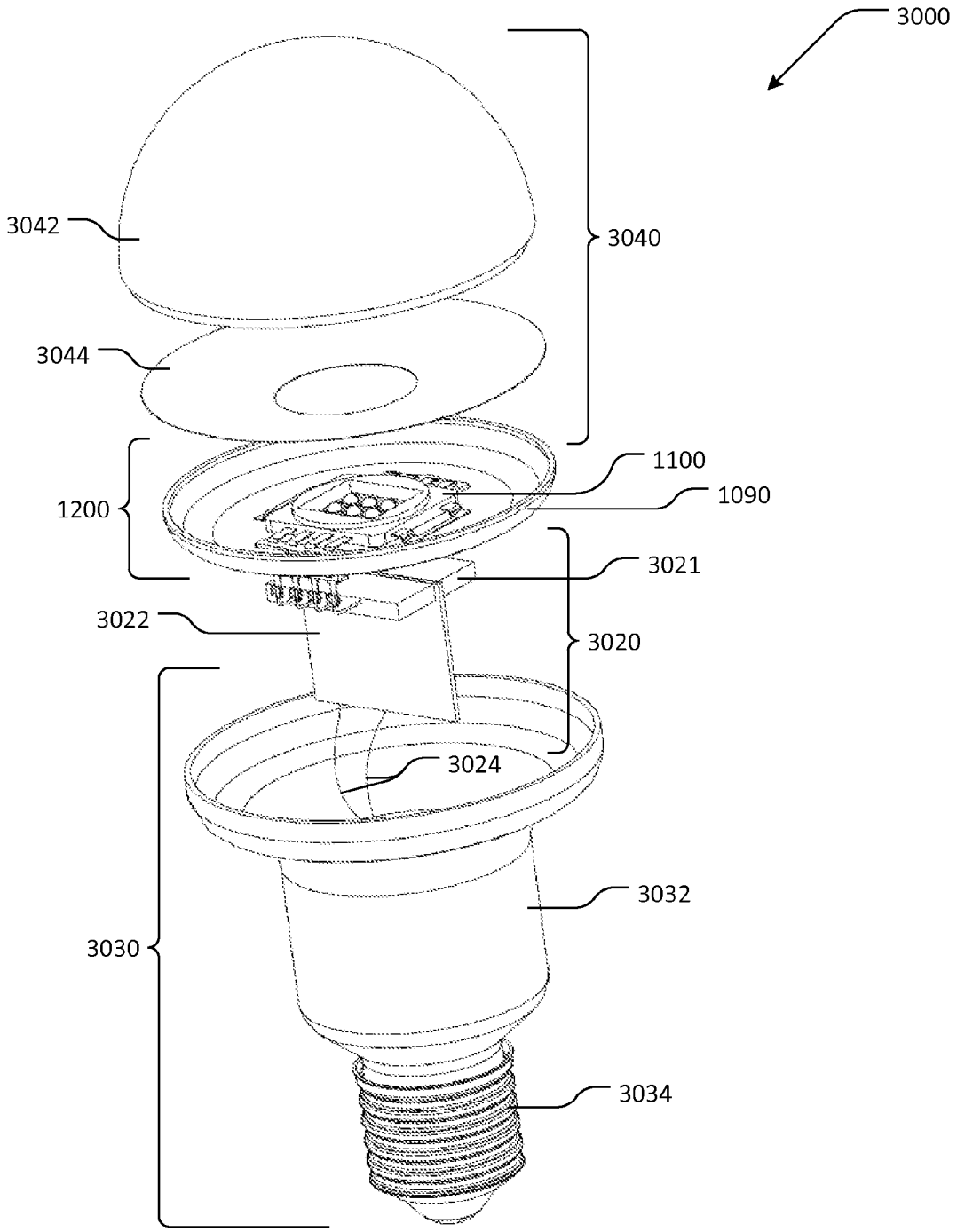
FIG. 1 is an exploded perspective view of one embodiment of the present invention.
Figure 2A:
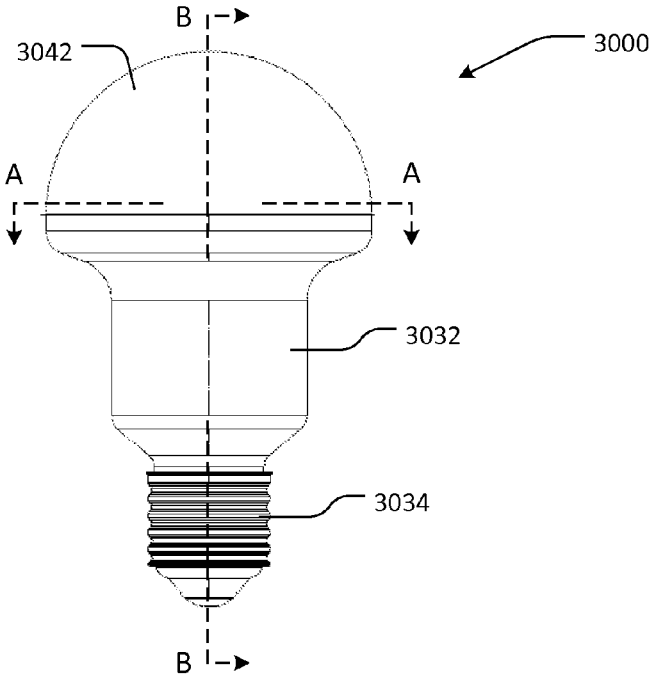
FIG. 2A is a side view of the embodiment of FIG. 1.
Figure 2B:
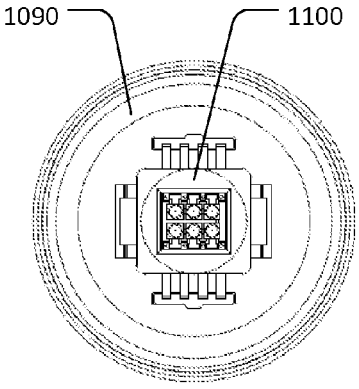
FIG. 2B is a cross sectional top view of the embodiment of the present invention of FIG. 1 cut along line A-A of FIG. 2A.
Figure 2C:
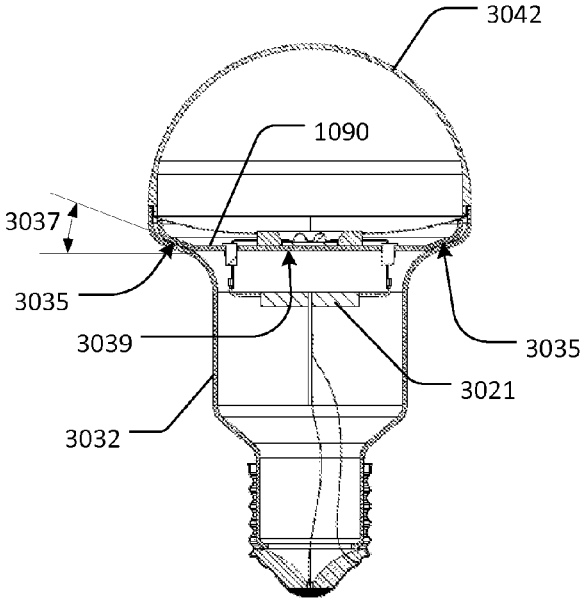
FIG. 2C is a cross sectional side view of the embodiment of the present invention of FIGS. 1 and 2A cut along line B-B of FIG. 2B.
Figure 3:
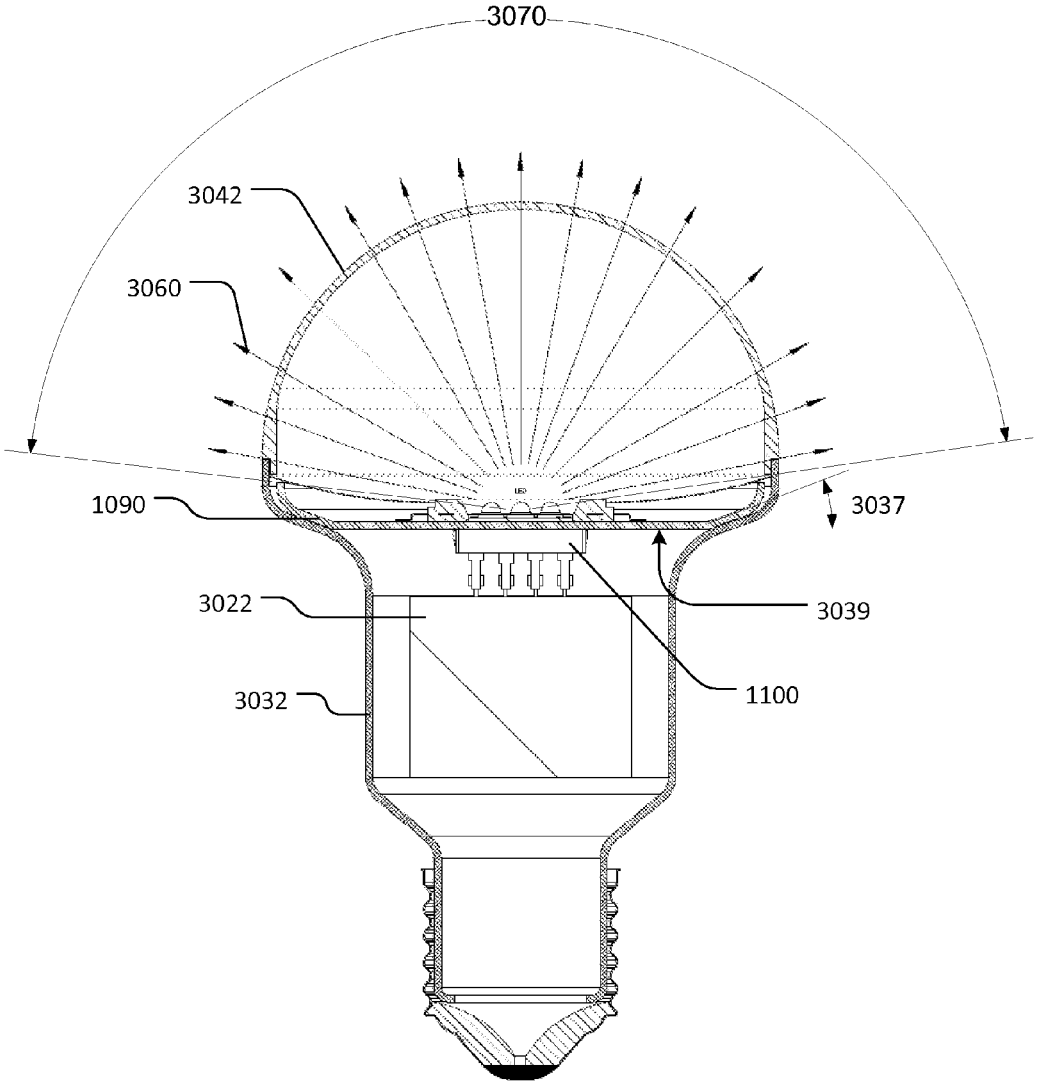
FIG. 3 is a partial cross sectional side view of the embodiment of FIG. 1 including light ray traces illustrating light propagation.

Globe Lamp 1—FIGS. 1 Through 3

FIG. 1 is an exploded perspective view of one embodiment of the present invention illustrated as a globe lamp 3000. FIG. 2A is a side view of the globe lamp 3000 of FIG. 1 with the globe lamp 3000 fully assembled; that is, FIG. 2A is not an exploded view. FIG. 2A is a side view when the components have been assembled. FIG. 2B is a cross sectional top view of the globe lamp 3000 cut along line A-A of FIG. 2A. FIG. 2C is a cross sectional side view of the globe lamp 3000 FIGS. 1 and 2A cut along line B-B of FIG. 2A. FIG. 3 is a partial cross sectional side view of the embodiment of FIG. 1 with illustrations of light propagation directions. In FIG. 3, light ray traces 3060 illustrate Lambertian radiation pattern emitted by the globe lamp. As illustrated in FIG. 3, the globe lamp 3000 of the present invention has a wide radiation pattern 3070.

Referring to FIGS. 1 through 3, the globe lamp 3000 includes an optical sub-assembly (OSA) 1200, electrical sub-assembly (ESA) 3020, body sub-assembly 3030, and final assembly (FA) 3040. The FA 3040 includes lens 3042 and reflector 3044. In the FA 3040, the reflector 3044 is placed proximal to the OSA 1200, and the lens 3042 covers at least a portion the OSA 1200. The OSA 1200 is also referred to as the light emitting subassembly 1200 in incorporated documents.

The OSA 1200 includes an LED light emitting module 1100 and an intermediate heat sink (IHS) 1090. The optical sub-assembly (OSA) 1200 may have be the light emitting subassembly 1200 of FIGS. 16 and 17 of patent application Ser. No. 13/019,900 filed on Feb. 2, 2011 entirety of which is incorporated by reference herein. The light emitting module 1100 is thermally coupled to the IHS 1090 by solder or thermal adhesive. Thus, little or no thermal resistance is present across the joint between the light emitting module 1100 and the IHS 1090. This also is discussed in more detail in the incorporated patent application Ser. No. 13/019,900.

The reflector 3044 is a separate component of globe lamp 3000. However, it may be implemented as a thin coating on the IHS 1090.

The ESA 3020 includes electrical driver board 3022 and electrical wires 3024. A connector 3021 can be used to connect the driver board 3022 to the light emitting module 1100. The connector 3021, in the present embodiment, is a molded plastic with copper wires, which is mounted on the driver board 3022 to allow electricity to flow from the electrical driver board 3022 and power the LED.

The BSA 3030 includes a body 3032 and a screw cap 3034. The body 3032 serves as an external heat sink relative to the light emitting module 1100, and also an enclosure for electrical components including, for example, the ESA 3020. The body 3032 and the IHS 1090 are connected by solder or thermal conductive adhesive for efficient heat transfer from the IHS 1090 to the body 3032.

The thermal contact between the IHS 1090 and the body 3032 is by means of taper lock. That is, the portion of the surface of the IHS 1090 that meets body 3032 and the portion of the surface of the body 3032 that meets the IHS 1090 are configured such that, at the area 3035 of contact, these surface portions meet flush against each other. Further, both of these surface portions are at an angle 3037 relative to a major plane 3039 of the IHS 1090. Because these two surface portions are at the same inclined angle, they meet and form a taper lock, and thus provide self-centering with very little clearance between them.

The screw cap 3034 includes portions of its external surface that is connected to the wires 3024. The wires 3034 connect the driver board 3022 to the screw cap 3034, thus electrically coupling the light emitting module 1100 to the screw cap 3034.

In operation, the light emitting module 1100 receives electrical power via the driver board 3022 which, in turn, receives the power from an external source through the wires 3024 directly or via the screw cap 3034 to which the wires 3024 are connected. When the electrical power is applied to the light emitting module 1100, the light emitting module 1100 generates light and heat.

Heat generated by the light emitting module 1100 flows from the module 1100 to its heat spreader (not illustrated here but illustrated and discussed in patent application Ser. No. 13/019,900), then to the IHS 1090, and finally to the body 3032 which dissipate the heat or conduct the heat to yet another heat sink. Accordingly, the body 3032 is an external heat sink relative to the light emitting module 1100.

The body 3032 houses the driver board 3022 and the wires 3024. The body 3032 also dissipates a relatively small amount of heat generated by the driver board 3022. The driver board 3022 and the body are thermally coupled via a thermal pad, such as silicone pad thereby allowing the driver board 3022 to cool. This allows electronic components mounted on the driver board 3022 to achieve high reliability and long life span.

The driver board 3022 electrically connects the light emitting module 1100 to the wires 3024, and ultimately, to an external power source that is the input electrical power to the lamp 3000. The driver board 3022 may include various electronic components such as a transformer (to step down high voltage of alternating current input power) and other electronics components such as rectifiers, resistors, capacitors and IC devices which perform power conversion from alternating current input to direct current used by the module 1100 and other functions such as power management.

Figure 4:
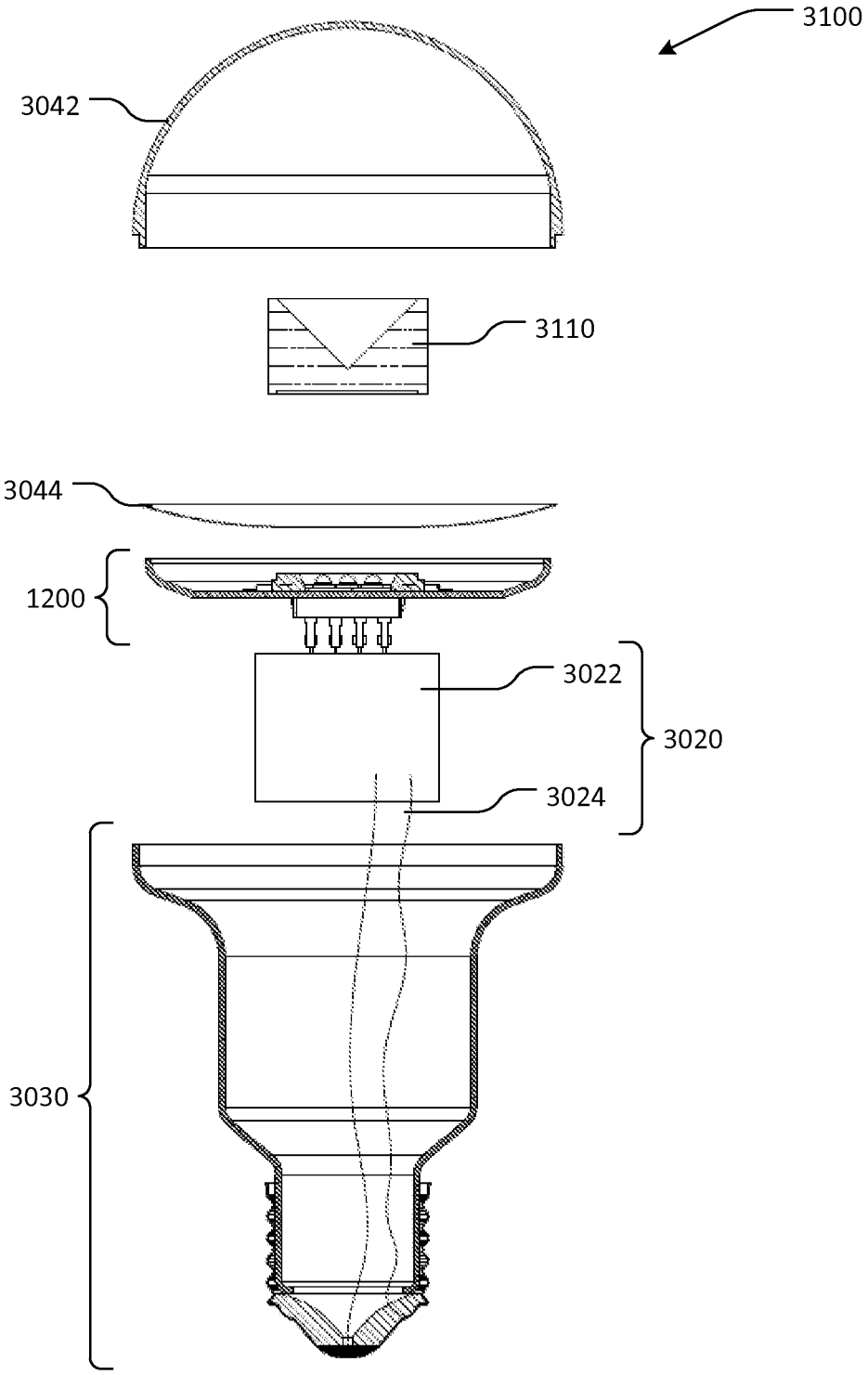
FIG. 4 is an exploded side view of another embodiment of the present invention.
Figure 5:
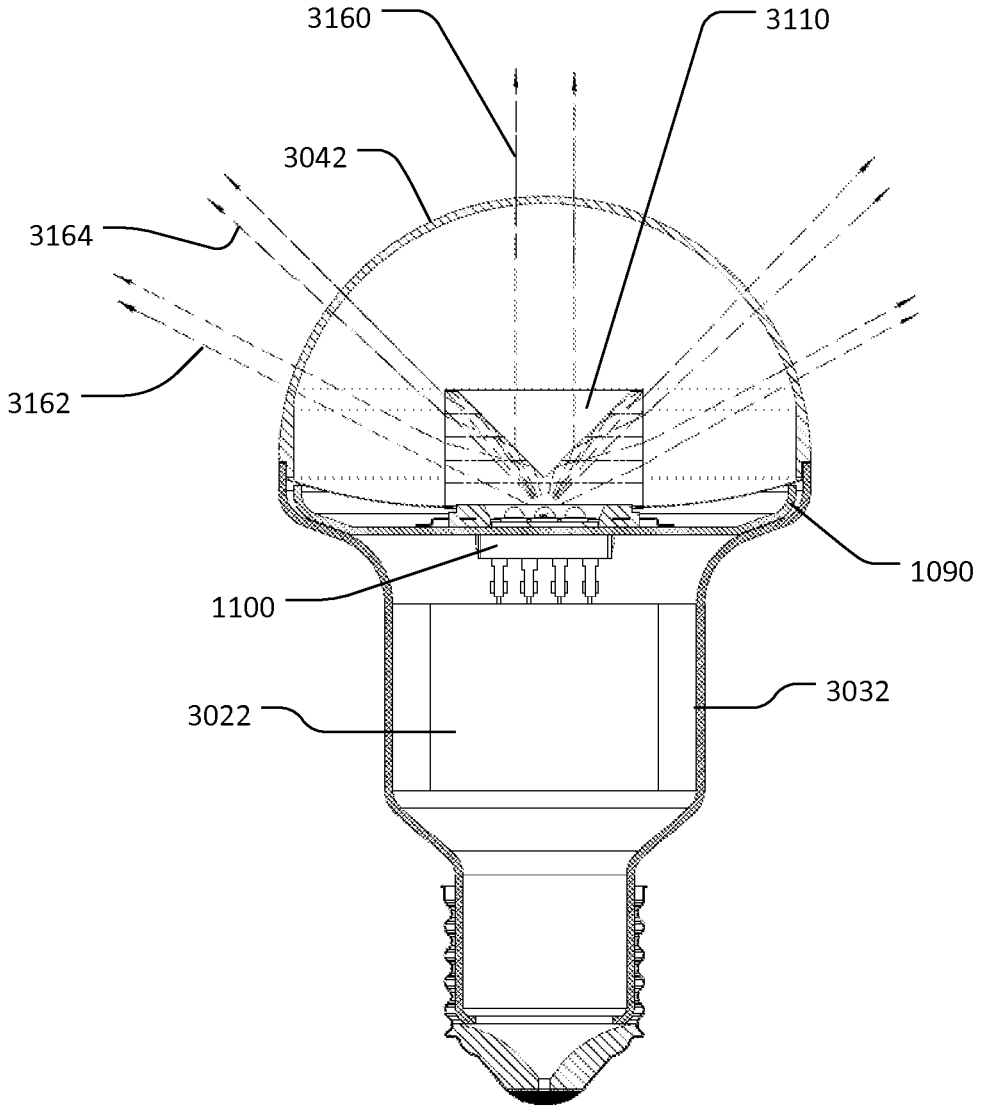
FIG. 5 is a cross sectional side view the embodiment of the present invention of FIG. 4 including light ray traces illustrating light propagation.

Globe Lamp 2—FIGS. 4 Through 5

FIG. 4 is an exploded side view of another embodiment of the present invention illustrated as a globe lamp 3100. FIG. 5 is a cross sectional side view the globe lamp 3100 of FIG. 4 that has been assembled and including ray traces illustrating light propagation.

Most of the globe lamp 3100 of FIGS. 4 and 5 are similar to corresponding portions of the globe lamp 3000 FIGS. 1 through 3. Similar to the globe lamp 3000 FIGS. 1 through 3, the globe lamp 3100 of FIGS. 4 and 5 includes an optical sub-assembly (OSA) 1200, the electrical sub-assembly (ESA) 3020, the body sub-assembly 3030, and the Final Assembly (FA) 3040 consisting of the lens 3042 and the reflector 3044.

However, in FIGS. 4 and 5, the globe lamp 3100 also includes an Internal Optical Element (IOE) 3110. The IOE 3110, an optical element, is optically coupled to LED chips of the light emitting module 1100. This is done by mounting the IOE 3110 on top of the light emitting module 1100 with a clear optical adhesive, for example, silicone, that fills up the space between the IOE 3110 and the light emitting module 1100. By selecting a silicone adhesive with refractive index same as the material used by the light emitting module 1100, the interface of the light emitting module 1100 to the air is eliminated and the only interface is at the external surface of the IOE 3110. The IOE 3110 can be imaging or non-imaging or a combination of both, to deliver any desired luminous effect needed in the lighting device.

Some light from the light emitting module 1100 is transmitted through the IOE 3110; this is illustrated by ray races 3160. Some light is refracted by the IOE 3110; this is illustrated by ray traces 3162. Some light is internally reflected (in a total internal reflection); this is illustrated by ray traces 3164. That is, depending on the optical design or configurations of the IOE 3110, the light from the light emitting module 1100 can be directed to result in desired patterns and in desired relative quantities.

In the prior art light bulbs, diffusants are added to their lenses or their lenses are frosted to diffuse light. Diffusants or frostings in lenses can lead to loss of light of approximately 15 percent. In the present embodiment, the IOE 3110 can be configured to shape the light. Accordingly, the need for diffusants in the lens is eliminated or at least minimized, thus light loss is eliminated or at least minimized. The lens 3042 can be attached to the IHS 1090 or the body 3032 depending on the desired implementation.

Figure 6:
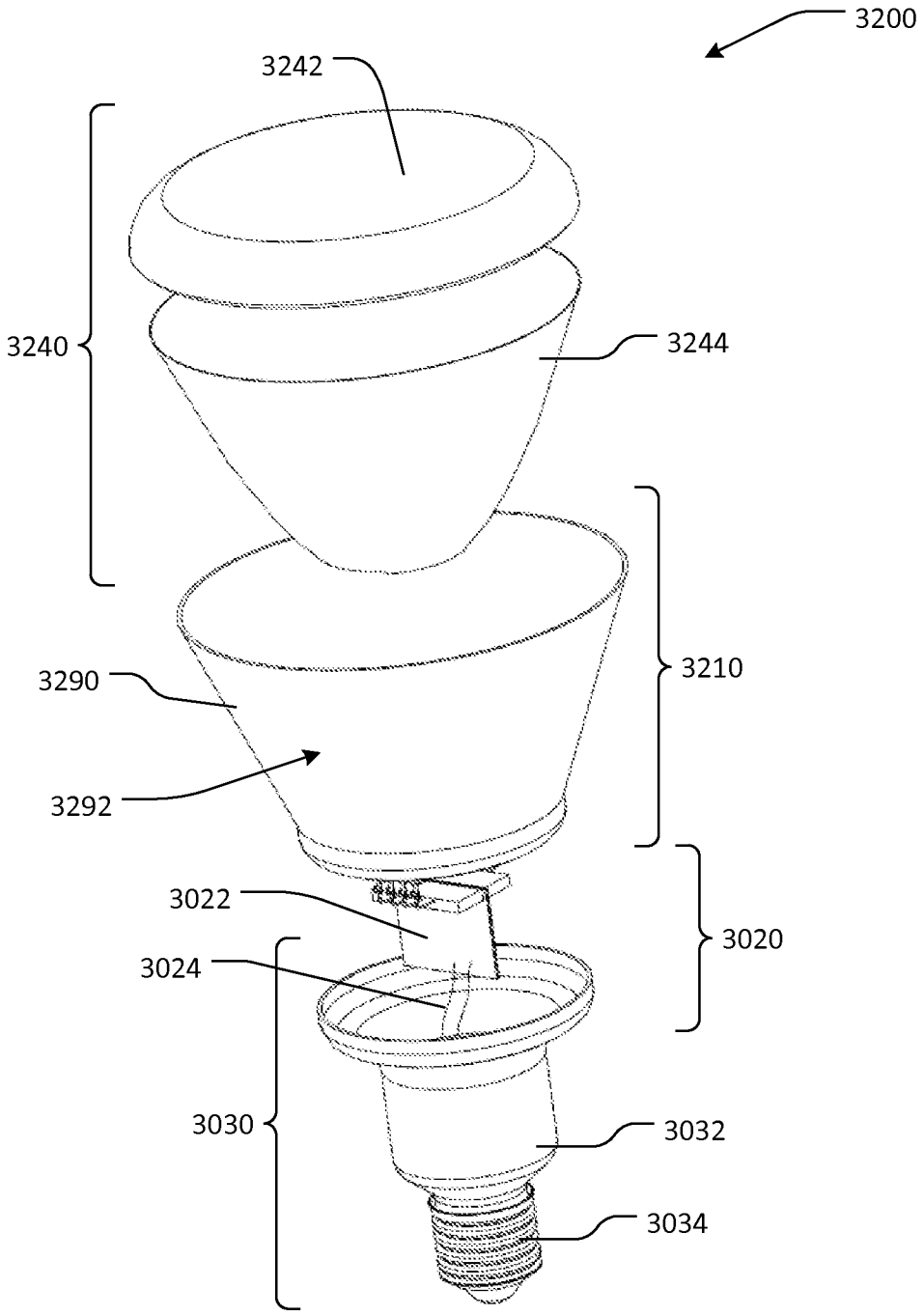
FIG. 6 is an exploded perspective view of yet another embodiment of the present invention.
Figure 7A:
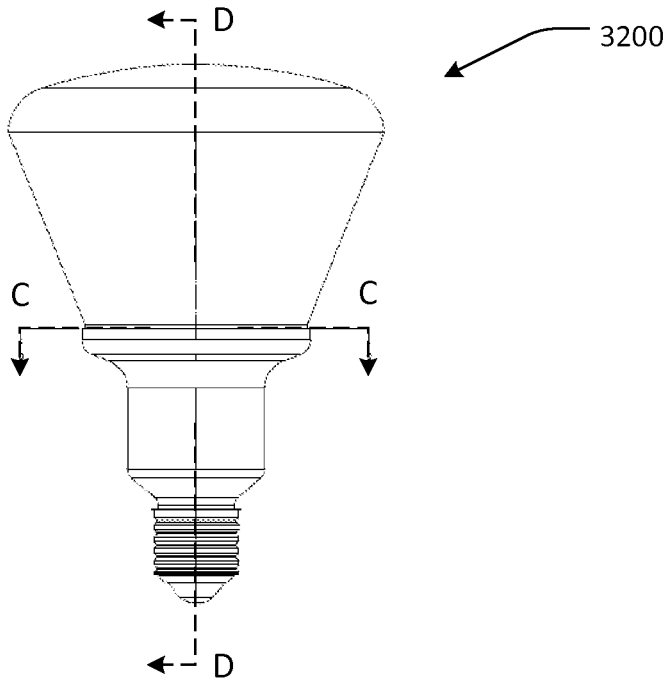
FIG. 7A is a side view of the embodiment of FIG. 6.
Figure 7B:
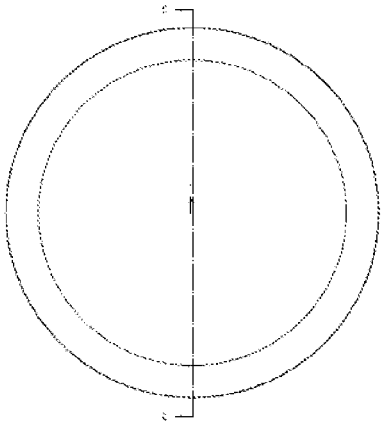
FIG. 7B is a top view of the embodiment of the present invention of FIG. 7A.
Figure 7C:
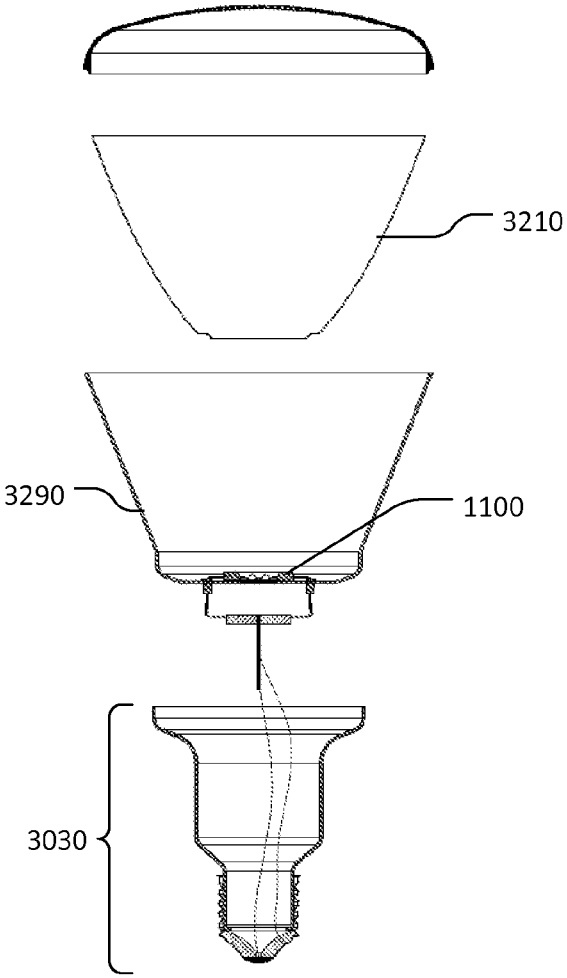
FIG. 7C is an exploded side view of the embodiment of the present invention of FIG. 7A.
Figure 7D:
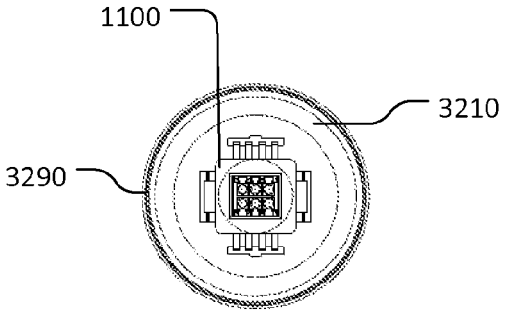
FIG. 7D is a cross sectional top view of the embodiment of the present invention of FIG. 7A cut along line C-C.
Figure 8:
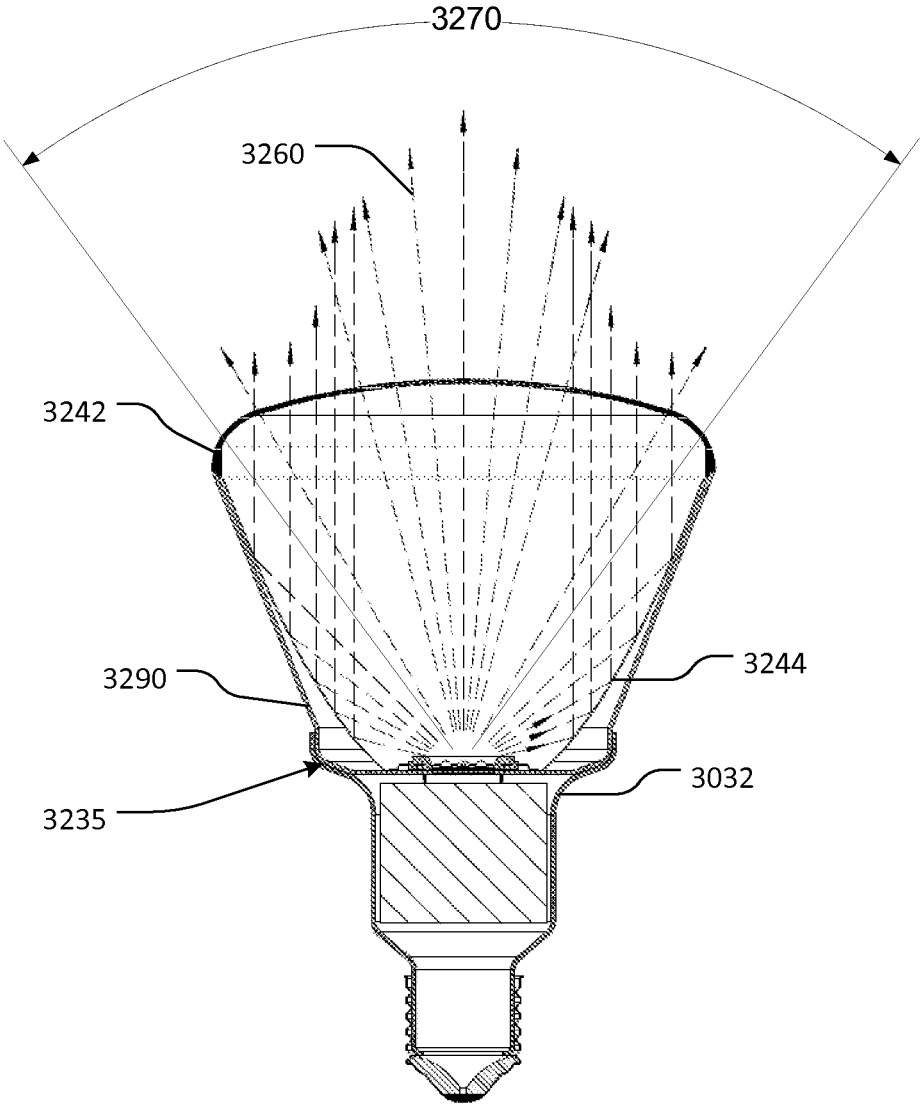
FIG. 8 is a cross sectional side view of the embodiment of FIG. 6 including light ray traces illustrating light propagation.

Parabolic Aluminized Reflector (Par) Lamp—FIGS. 6 Through 8

FIG. 6 is an exploded perspective view of yet another embodiment of the present invention illustrated as a Parabolic Aluminized Reflector (PAR) lamp 3200. FIG. 7A is a side view of the PAR lamp 3200 of FIG. 6. FIG. 7B is a top view of the PAR lamp 3200 of FIG. 6. FIG. 7C is an exploded side view of the PAR lamp 3200 of FIG. 6. FIG. 7D is a cross sectional top view of the PAR lamp 3200 of FIG. 6 cut along line C-C of FIG. 7A. FIG. 8 is a partial cross sectional side view of the PAR lamp 3200 of FIG. 6 including light ray traces illustrating light propagation.

Referring to FIGS. 6 through 8, the PAR lamp 3200 includes many portions that are identical to the globe lamp 3000 of FIG. 1. The PAR lamp 3200 includes the electrical sub-assembly (ESA) 3020 and the body sub-assembly 3030 identical to the globe lamp 3000 of FIG. 1. However, in the PAR lamp 3200, its optical sub-assembly (OSA) 3210 includes the light emitting module 1100 and an intermediate heat sink (IHS) 3290 that is larger than the IHS 1090 of the globe lamp 3000 of FIG. 1. In the PAR lamp 3200, the larger IHS 3290, with its exposed surface 3292, provides additional heat dissipating surface area.

Further the PAR lamp 3200 includes a Final Assembly 3240 including a lens 3242 and a parabolic reflector 3244. The reflector 3244 is placed proximal to the light emitting module 1100 to enable a desired optical performance of the PAR lamp 3200. The reflector 3244 is housed and protected by the IHS 3290 and also by the lens 3242 from hazardous elements such as dusts and moisture. As illustrated in the Figures, the components of the Final Assembly 3240 differ in size and shape to the size and the shape of the corresponding components of the Final Assembly 3040 of the globe lamp 3000 of FIG. 1. This, of course, is due to differences in the desired application and characteristics of the PAR lamp 3200 compared to those of the globe lamp 3000. The reflector 3244 is a separate component of PAR lamp 3200. However, it may be implemented as a thin coating on the IHS 3290.

Here, the heat generated by the light emitting module 1100 is transferred to the IHS 3290 with minimal or no thermal resistance. This is because the light emitting module 1100 is thermally coupled to the IHS 3290 via solder or other high efficiency thermal adhesive. A portion of the transferred heat is dissipated by the IHS via its large exposed surface 3292.

Another portion of the heat is transferred to the body 3032 to be dissipated by the body 3032. Again, the transfer is with minimal or no thermal resistance. This is because the IHS 3290 is thermally connected to the body 3032 using solder or high efficiency thermal adhesive.

The thermal contact between the IHS 3290 and the body 3032 is by means of taper lock. That is, the portion of the surface of the IHS 3290 that meets body 3032 and the portion of the surface of the body 3032 that meets the IHS 3290 are configured such that, at the area 3235 of contact, these surface portions meet flush against each other. Because these two surface portions have the same curve, they meet and form a taper lock, and thus provide self-centering with very little clearance between them.

Collectively, then, both the IHS 3290 and the body 3032 draws heat away from the light emitting module 1100 for dissipation. This allows the light emitting module 1100 to operate at a lower temperature. Lower temperature operations are more efficient operation, increases reliability, and as long device.

In FIG. 8, light ray traces 3260 illustrate the radiation pattern emitted by the PAR lamp 3200. As illustrated in FIG. 6, the PAR lamp 3200 of the present invention has a radiation pattern 3270 that is narrower than the radiation pattern of 3070 of the globe lamp 3000 of FIGS. 1 and 3. This is due to the reflector 3244.

Figure 9:
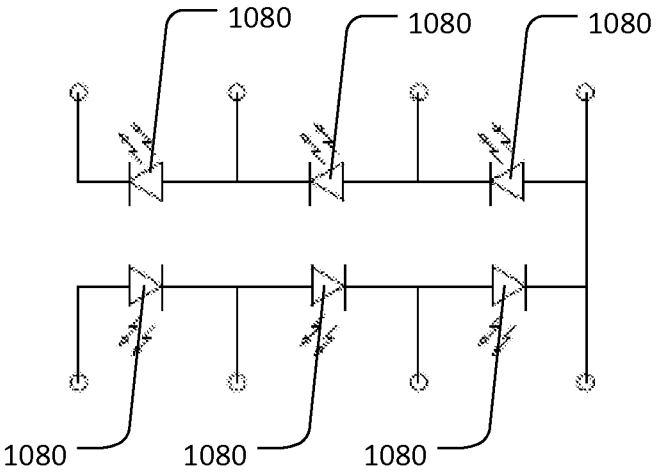
FIG. 9 is an electrical circuit schematic illustrating yet another aspect of the present invention.

Internal Circuitry—FIG. 9

FIG. 9 is an electrical circuit schematic illustrating yet another aspect of the present invention. FIG. 9 illustrations the electrical circuit schematic illustrating light emitting elements 1080 of the light emitting module 1100 illustrated in various Figures of the present document and in the incorporated patent application Ser. No. 13/019,900. Because the light emitting elements 1080 are electrically connected in parallel, each light emitting elements 1080 can be turned on and off separately. This configuration allows the light emitting module 1100 to be controlled to produce varying levels light.

Figure 10:
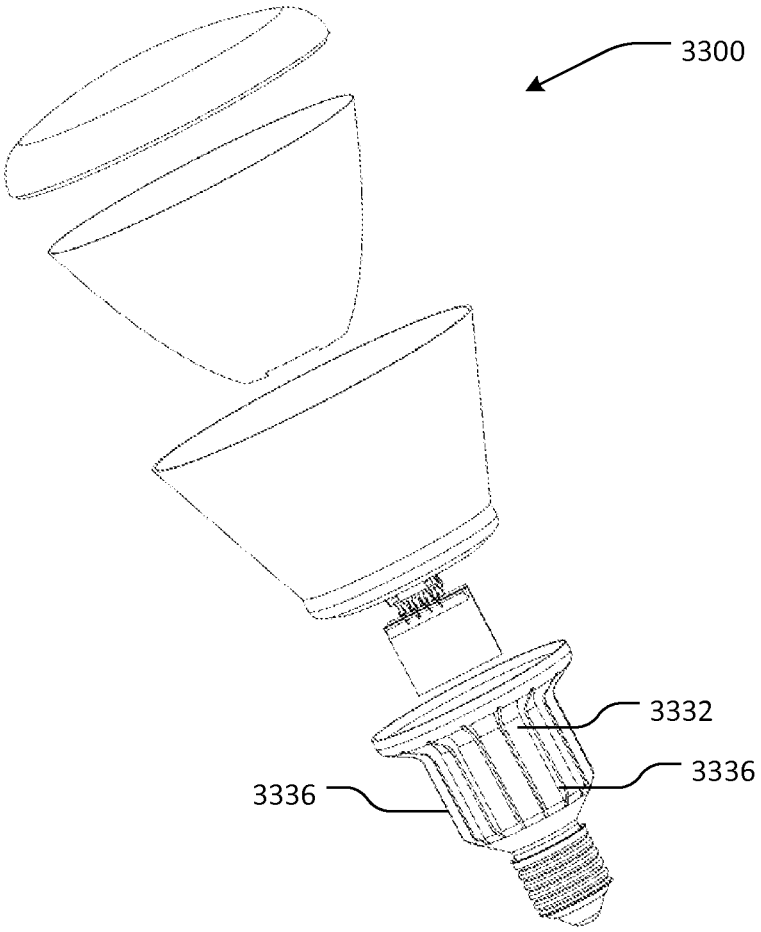
FIG. 10 is an exploded perspective view of yet another embodiment of the present invention.

Parabolic Aluminized Reflector (Par) Lamp with Heat Sink Fins—FIG. 10

FIG. 10 is an exploded perspective view of yet another embodiment of the present invention illustrated as a PAR lamp 3300. The PAR lamp 3300 is similar to the PAR lamp 3200 of FIGS. 6 through 8 except for its body 3332. Referring to FIG. 10, the PAR lamp 3300 includes a body 3332 having heat sink fins 3336. The heat sink fins 3336 increase the outer surface area of the body 3332 leading to great heat dissipation.

Figure 11A:
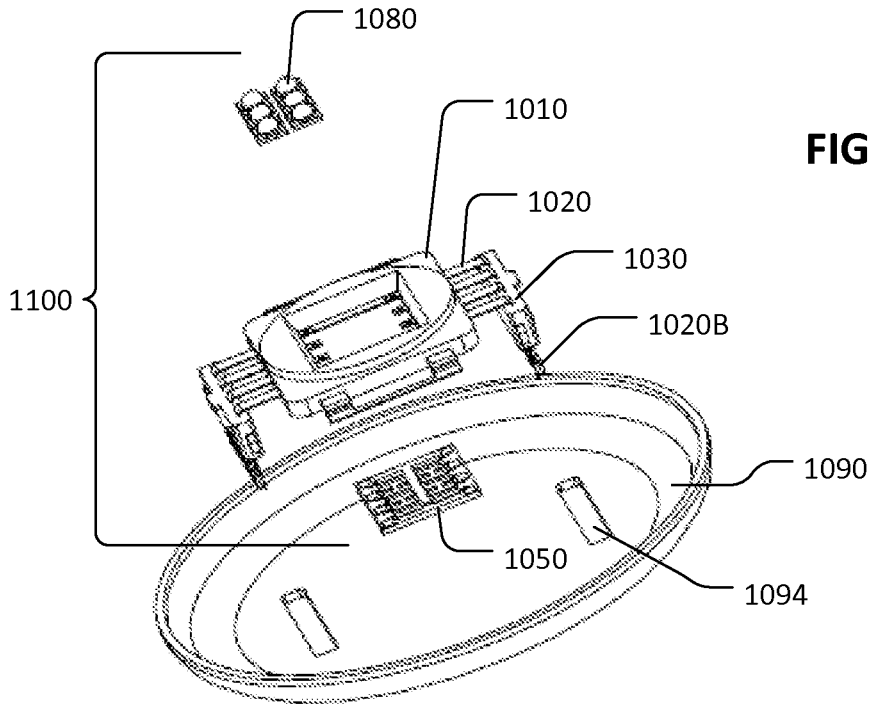
FIG. 11A is an exploded perspective view of another aspect of the present invention.
Figure 11B:
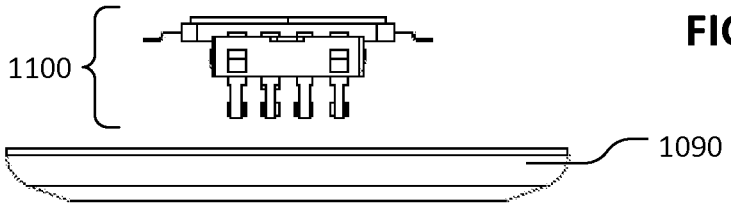
FIG. 11B is an exploded side view of the embodiment of FIG. 11A.
Figure 11C:
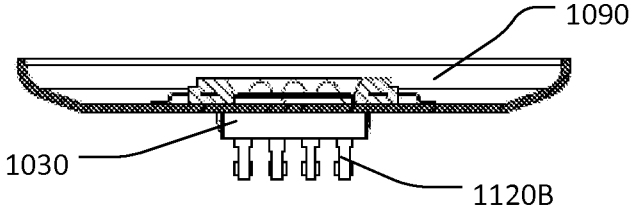
FIG. 11C is a cross sectional side assembled view of portions of the embodiment of FIG. 11A cut along line D-D of FIG. 11D.
Figure 11D:
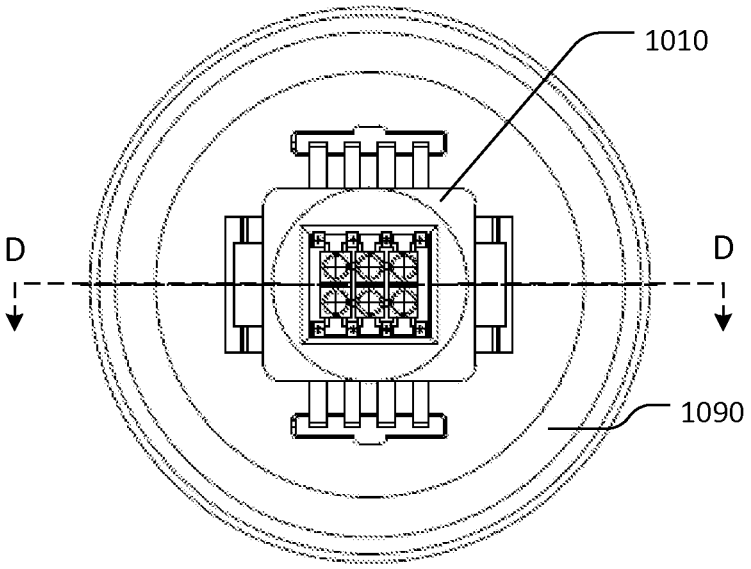
FIG. 11D is a top view of portions of the embodiment of FIG. 11A.
Figure 12:
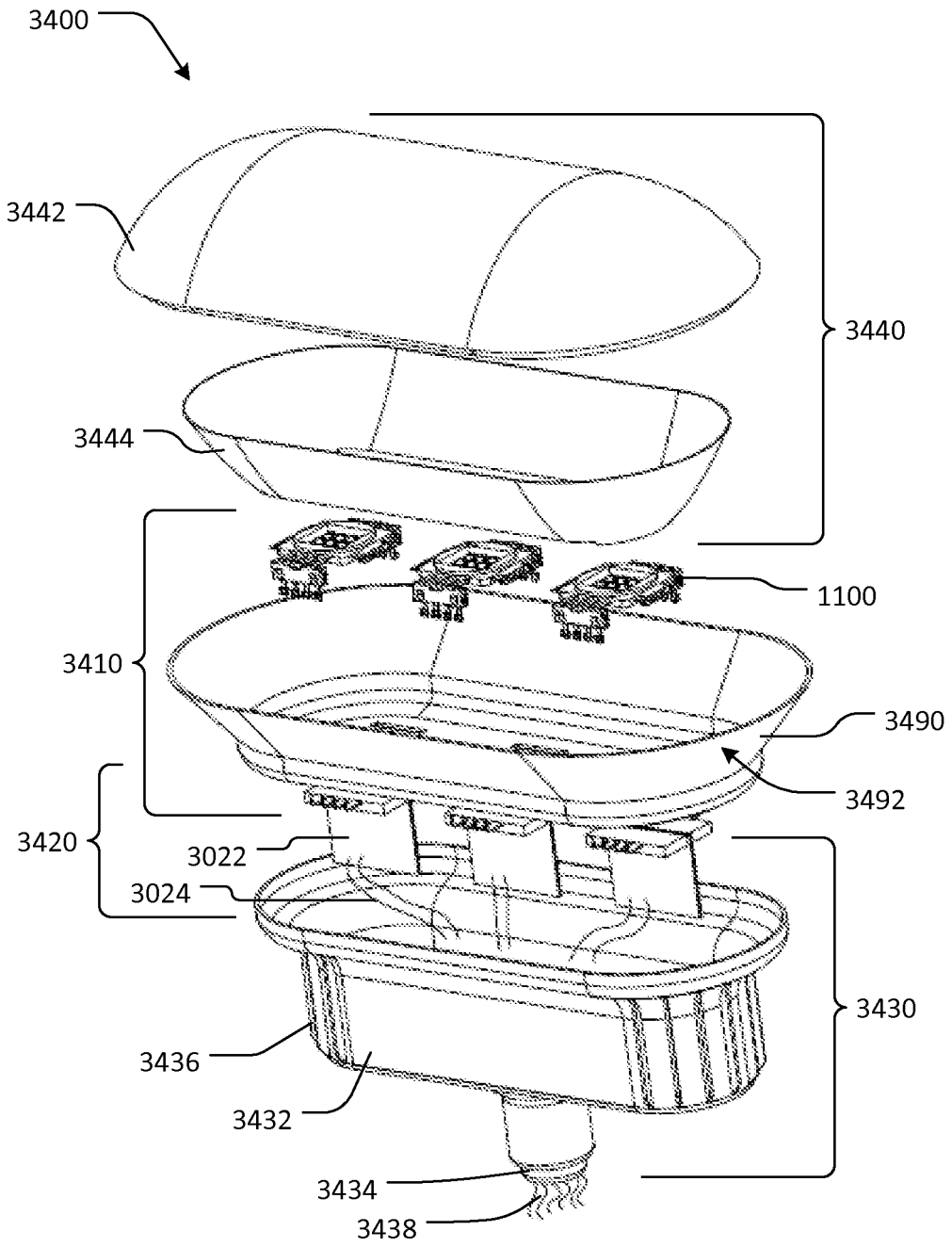
FIG. 12 is an exploded perspective view of yet another embodiment of the present invention.

The Optical Sub-Assembly (OSA) 1200—FIGS. 11 Through 13

FIG. 11A is an exploded perspective view of optical sub-assembly (OSA) 1200 including the light emitting module 1100 and the IHS 1090. FIG. 11B is an exploded side view of the OSA 1200. FIG. 11C is a cut away cross sectional side view of the light emitting module 1100 and the IHS 1090 cut along line D-D of FIG. 11D. FIG. 11D is a top view of the light emitting module 1100 and the IHS 1090.

As illustrated, the light emitting diode 1100 includes lead frame 1020, a lead frame body 1010 encapsulating portions of the lead frame 1020, snap in body 1030 encapsulating another portions of the lead frame 1020, and outer ends 1020B of the lead frame 1020. Further, light emitting diode 1100 includes the light emitting elements 1080 mounted on the heat sink 1050.

The intermediate heat sink 1090 defines slots 1094 to allow portions of the light emitting module 1100 to pass through the slots and thereby engage the intermediate heat sink 1090. Further, the slots 1094 aid in alignment of the intermediate heat sink 1090 to the light emitting module 1100. Using this alignment technique, the manufacturing process is less labor intensive compared to the manufacturing process of the existing products. This results in higher yield and lower cost of assembly. The OSA 1200 and its components and subcomponents are described in more detail in the incorporated patent application Ser. No. 13/019,900.

Figure 13A:
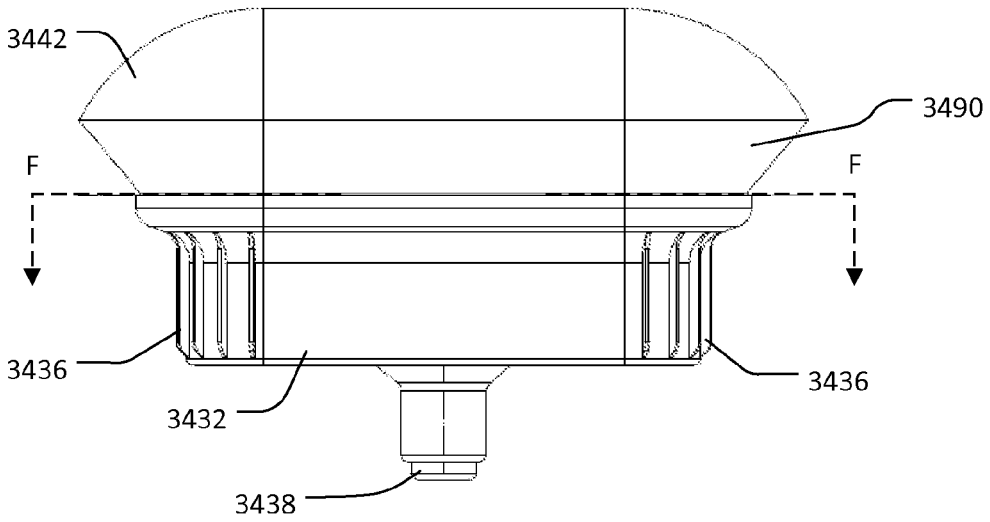
FIG. 13A is a first side view of the embodiment of FIG. 12.
Figure 13B:
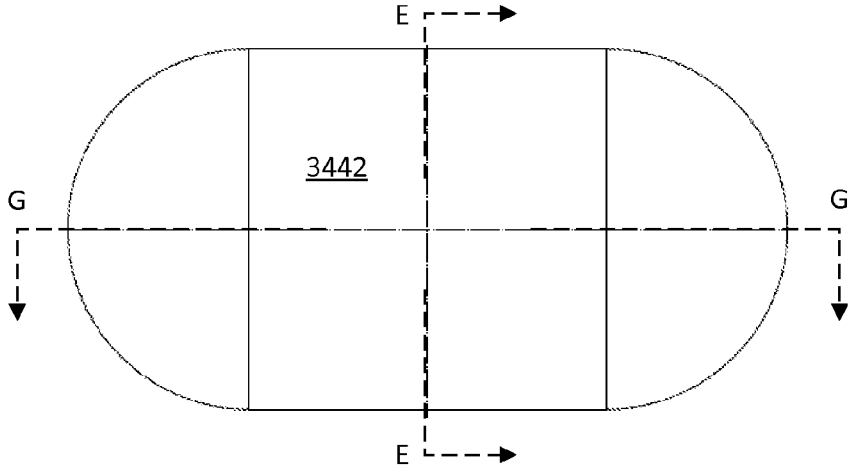
FIG. 13B is a top view of the embodiment of FIG. 12.
Figure 13C:
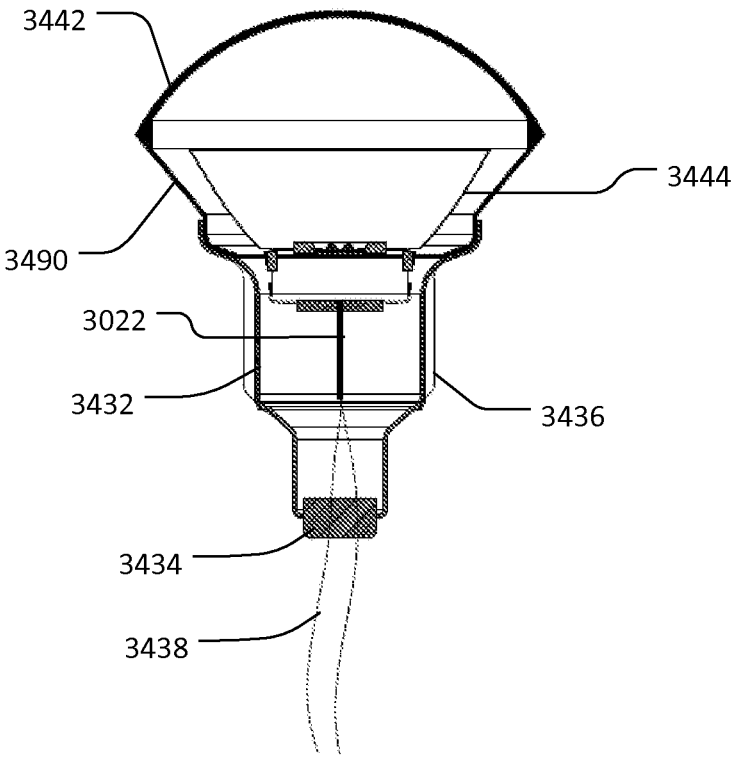
FIG. 13C is a partial cross sectional second side view of the embodiment of FIG. 15B cut along line E-E of FIG. 13B.
Figure 13D:
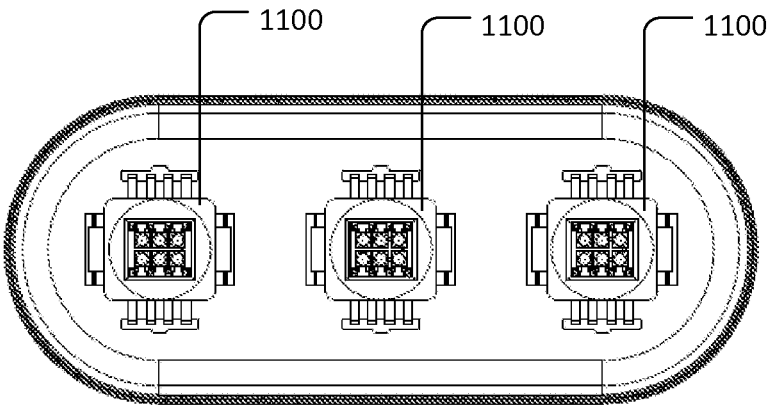
FIG. 13D is a cross sectional top view of the embodiment of FIG. 12 cut along line F-F of FIG. 13A.
Figure 14:
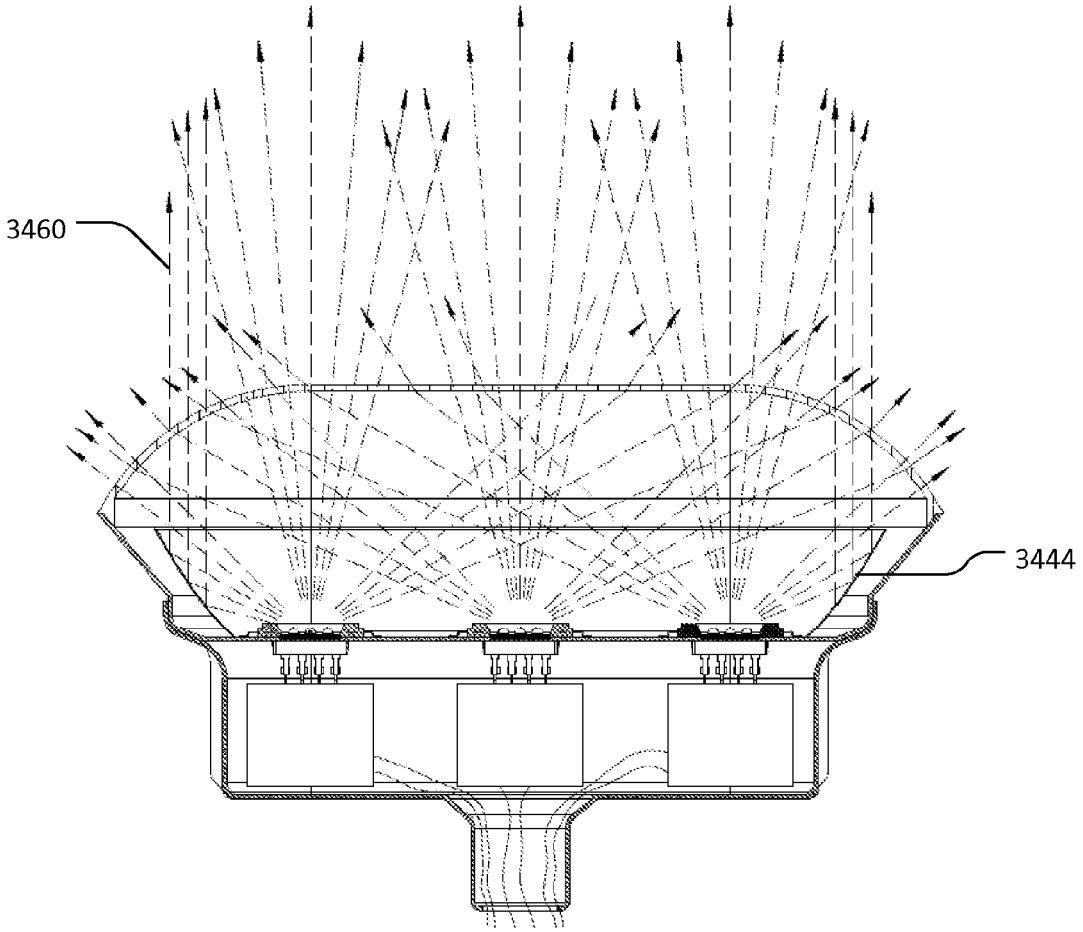
FIG. 14 is a partial cross sectional first side view of the embodiment of FIG. 12 cut along line G-G of FIG. 13B, the view including light ray traces illustrating light propagation.

Luminaire Lamp—FIGS. 12 Through 14

FIG. 12 is an exploded perspective view of yet another embodiment of the present invention illustrated as a luminaire 3400. FIG. 13A is a first side view of the luminaire 3300 of FIG. 12. FIG. 13B is a top view of the luminaire 3400 of FIG. 12. FIG. 13C is a partial cross sectional second side view of the luminaire 3400 of FIG. 12 cut along line E-E of FIG. 13B. FIG. 13D is a cross sectional top view of the luminaire 3400 of FIG. 12 cut along line F-F of FIG. 13A. FIG. 14 is a partial cross sectional first side view of the luminaire 3400 of FIG. 12 cut along line G-G of FIG. 13B, the view including light ray traces illustrating light propagation.

Referring to FIGS. 12 through 14, the luminaire 3400 include many portions that are identical to or similar to the globe lamp 3000 of FIG. 1 and the PAR lamp 3200 of FIG. 6. Here, the luminaire 3400 is, fundamentally, an enlarged version of the PAR lamp 3200 of FIG. 6 configured to accommodate multiple light emitting modules 1100.

The luminaire 3400 includes an optical sub-assembly (OSA) 3410, electrical sub-assembly (ESA) 3420, body sub-assembly 3430, and final assembly (FA) 3440. The OSA 3410 includes at least two light emitting modules 1100 and an intermediate heat sink (IHS) 3490 includes mounting slots configured to accommodate the multiple light emitting modules 1100. The slots 1094 are illustrated in FIG. 11A in the context of the IHS 1090. The IHS 3490 includes a plurality of similar slots.

In the illustrated embodiment, the OSA 3410 includes three light emitting modules 1100; however, the OSA 3410 may include any number of light emitting modules 1100. The IHS 3490, similar to the IHS 3290 of the PAR lamp 3200, includes external surface 3492 that is exposed and not enclosed by the body 3432 where the external surface 3492 contributes to the heat dissipation of the luminaire 3400. The IHS 3490 is larger than the IHS 3290 of the PAR lamp 3200 to accommodate additional light emitting modules 1100.

The ESA 3420 is similar to the ESA 3020 of the globe lamp 3000; however, for the luminaire 3400, the ESA 3420 includes multiple driver boards 3022 to connect to the multiple light emitting modules 1100. Similarly, the ISA 3420 includes multiple pairs of wires 3024 for the same reason.

In the BSA 3430, the body 3432 is shaped to accommodate the shape and the size of the IHS 3490. Here, the body 3420 is larger than the body 3220 of the PAR lamp 3200 to accommodate the larger IHS 3490. Similar to the PAR lamp 3300 of FIG. 10, the body 3432 includes heat sink fins 3436 to increase surface area to increase heat dissipation. The BSA 3430 includes a plug 3434 that may or may not be a screw cap 3034 of the PAR lamp 3200. Connection to external electrical power may be made via the surface of the plug 3434 to which the wires 3024 may be connected. Alternatively, connection to external electrical power may be made via external wires 3438 extending out of the plug 3434. In such configuration, the electrical connection extends from the light emitting modules 1100, via the driver boards 3022 and the wires 3024, to beyond the BSA 4330. This allows for external electrical power to be delivered to the light emitting modules 1100.

The FA 3440 includes lens 3442 and reflector 3444 with the lens 3442 having shape and size to engage the IHS 3490 and covering the light emitting modules 1100. The reflector 3444 is enclosed by the lens 3442 and the IHS 3490. The reflector 3444 is placed proximal to the light emitting modules 1100 to enable a desired optical performance of the luminaire 3400.

In FIG. 14, light ray traces 3460 illustrate the radiation pattern emitted by the luminaire 3400. As illustrated in FIG. 14, the luminaire 3400 has a radiation pattern consistent with the shape of the luminaire 3400 and its components including the reflector 3444.

CONCLUSION

From the foregoing, it will be appreciated that the present invention is novel and offers advantages over the existing art. Although a specific embodiment of the present invention is described and illustrated above, the present invention is not to be limited to the specific forms or arrangements of parts so described and illustrated. For example, differing configurations, sizes, or materials may be used to practice the present invention. The present invention is not limited to the sample lamp embodiments illustrated herein above; rather, the present invention includes any type of light bulbs or lighting device.

I claim:

1. A lighting device comprising:

a body;

an intermediate heat sink having mounting slots, said intermediate heat sink thermally coupled to said body;

a light emitting module mounted on said intermediate heat sink wherein a portion of said light emitting module passes through the mounting slots to engage said intermediate heat sink, said light emitting module thermally coupled to said intermediate heat sink;

electrical connection from said light emitting module to a screw cap allowing delivery of external electrical power to said light emitting modules; and wherein heat from said light emitting module is drawn to said intermediate heat sink, then to said body for dissipation.

2. The lighting device recited in claim 1 wherein said body includes a plurality of heat sink fins.

3. The lighting device recited in claim 1 further comprising a reflector proximal to said light emitting modules; and a lens covering said light emitting modules.

4. The lighting device recited in claim 1 wherein solder thermally couples said light emitting modules and said intermediate heat sink.

5. The lighting device recited in claim 1 wherein thermal adhesive thermally couples said light emitting modules and said intermediate heat sink.

6. The lighting device recited in claim 1 wherein said intermediate heat sink includes exposed external surface.

7. The lighting device recited in claim 1 further comprising a lens attached to said body.

8. The lighting device recited in claim 1 further comprising a lens attached to said intermediate heat sink.

9. The lighting device recited in claim 1 wherein solder thermally couples said intermediate heat sink and said body.

10. The light device recited in claim 1 wherein said intermediate heat sink is coupled to said body via a taper lock.

11. The light device recited in claim 1 further comprising a driver board comprising electronic components processing input electrical power, said driver board thermally coupled to said body.

12. A lighting device comprising:

a body;

an intermediate heat sink having a plurality of slots, said intermediate heat sink thermally coupled to said body;

a plurality of light emitting modules mounted on said intermediate heat sink, each light emitting module thermally coupled to said intermediate heat sink wherein a portion of each of said light emitting modules passes through the slots to engage said intermediate heat sink;

electrical connection from said light emitting modules extending beyond said body allowing delivery of external electrical power to said light emitting modules; and wherein heat from said light emitting modules is drawn to said intermediate heat sink, then to said body for dissipation.

13. The lighting device recited in claim 12 wherein said intermediate heat sink includes an exposed external surface.

14. The lighting device recited in claim 12 wherein said body includes a plurality of heat sink fins.

15. The lighting device recited in claim 12 further comprising a reflector proximal to said light emitting modules; and a lens covering said light emitting modules.

16. The lighting device recited in claim 12 wherein said light emitting modules are thermally coupled to said intermediate heat sink using solder.

17. The lighting device recited in claim 12 wherein said light emitting modules are thermally coupled to said intermediate heat sink using thermal adhesive.

18. The lighting device recited in claim 12 further comprising a lens attached to said body.

19. The lighting device recited in claim 12 further comprising a lens attached to said intermediate heat sink.

20. The light device recited in claim 12 wherein said intermediate heat sink is coupled to said body via a taper lock.

* * * * *